US005390868A

United States Patent [19]

Kiriake

[11] Patent Number: 5,390,868

[45] Date of Patent: Feb. 21, 1995

[54] BOBBIN CONVEYOR SYSTEM FOR CARRYING AND DISCRIMINATING AMONG VARIOUS KINDS OF BOBBINS

[75] Inventor: Masaharu Kiriake, Uji, Japan

[73] Assignee: Murata Kikai Kabushiki Kaisha, Kyoto, Japan

[21] Appl. No.: 56,027

[22] Filed: Apr. 30, 1993

[30] Foreign Application Priority Data

May 7, 1992 [JP] Japan ..... 4-143194

[51] Int. Cl.[6] ..... B65H 67/06; D01H 9/18

[52] U.S. Cl. ..... 242/35.50 A; 57/90; 57/264; 57/281; 242/35.50 R

[58] Field of Search ..... 242/35.5 A, 35.5 R; 57/90, 281, 264

[56] References Cited

U.S. PATENT DOCUMENTS

| | | | |
|---|---|---|---|
| 4,545,551 | 10/1985 | Uchida et al. | 242/35.5 A |
| 4,576,341 | 3/1986 | Matsui et al. | 242/35.5 A |
| 4,660,370 | 4/1987 | Matsui et al. | 57/281 |
| 4,681,231 | 7/1987 | Ueda et al. | 242/35.5 A X |
| 4,809,919 | 3/1989 | Ueda et al. | 242/35.5 A X |
| 4,856,723 | 8/1989 | Tone | 242/35.5 A X |
| 5,100,073 | 3/1992 | Moehrke et al. | 242/35.5 R X |
| 5,107,667 | 4/1992 | Tone et al. | 57/281 X |
| 5,174,103 | 12/1992 | Nishioka | 57/281 |
| 5,269,478 | 12/1993 | Wakabayashi et al. | 242/35.5 A |
| 5,287,692 | 2/1994 | Matsubayashi | 57/90 X |

FOREIGN PATENT DOCUMENTS

| | | |
|---|---|---|
| 1185421 | 7/1989 | Japan . |
| 1192678 | 8/1989 | Japan . |

*Primary Examiner*—Lenard A. Footland
*Assistant Examiner*—William Stryjewski
*Attorney, Agent, or Firm*—Spensley Horn Jubas & Lubitz

[57] ABSTRACT

A conveyor system for carrying various kinds of bobbins which can easily and reliably discriminate a wrong combination of a tray with a specific mark and a color bobbin of specific color, wherein a spinning bobbin wound on a color bobbin of specific color is inserted on a tray having a specific mark; the tray having the specific mark is selected by a tray selector from a main conveyor line on which two or more kinds of trays are transported together, being distributed to delivery lines and of specific winding unit groups. In the delivery lines, color sensors are mounted for discriminating color bobbins of specific color.

5 Claims, 6 Drawing Sheets

BOBBIN CONVEYOR SYSTEM FOR CARRYING AND DISCRIMINATING AMONG VARIOUS KINDS OF BOBBINS

BACKGROUND OF THE INVENTION

1. Field of the Invention

The present invention relates to a conveyor system for carrying various kinds of bobbins connecting two or more fine spinning frames for producing a spinning bobbin wound with a specific kind of yarn to an automatic winder divided into at least two winding unit groups correspondingly to these fine spinning frames.

2. Prior Art

In this type of conveyor system, various kinds of bobbins are conveyed together from two Or more fine spinning frames; before each winding unit group a specific kind of spinning bobbin must be selected, being diverted to a delivery line for each winding unit group. As shown in FIG. 2*a*, 2*b*, 2*c*, therefore, a spinning bobbin 1 wound with a specific kind of yarn on a color bobbin 2 of specific color is inserted on a tray 3 provided with a specific mark, so that the yarn thus wound can be discriminated to be of the specific kind. Concretely, one of three slits 6A, 6B and 6C which are cut in different positions in a vertical direction is provided around a disk-shaped base 5 of a tray 3 carrying the specific mark; further, generally the whole body of the tray 3 is colored for example white, black and blue correspondingly to the positions of the slits 6A, 6B and 6C. The color bobbin 2 of the specific color is colored red, blue and green all over; the specific kind of a spinning bobbin is a spinning bobbin wound on the color bobbin of the specific color.

At the front of each winding unit group, a spinning bobbin of specific kind is selected and distributed in accordance with the specific mark of the tray 3. A tray selector 41 provided for this purpose will be explained with reference to FIG. 3. The tray selector 41 consists of three flappers 42 vertically arranged, a driving unit 43 operating on the basis of these flappers 42, and a gate 44 which is operated to switch by means of this driving unit 43. When some of the three flappers 42 is moved as illustrated, by a slit located in a specific position of the tray 3, a gate 44 will be switched to the position of a broken line 49 by the driving unit 43, thus distributing the tray 3 of the specific mark for example.

Next, an example of a conveyor line in conventional use for conveying various kinds of bobbins having the above-mentioned tray selector 41 will be explained with reference to FIGS. 4 to 6. FIG. 4 is a layout showing one example of the conveyor system for various kinds of bobbins; FIG. 5 is a plan view of a major portion of the conveyor system; and FIG. 6 is a perspective view of a winding unit.

In FIG. 4, there are set up winding unit groups, one for each fine spinning frame; when different kinds of yarns are produced at fine spinning frames SP1 to SP3, the yarn from the fine spinning frame SP1 is rewound by a winding unit group SC1; the yarn from the fine spinning frame SP2 is rewound by a winding unit group SC2; and the yarn from the fine spinning frame SP3 is rewound by a winding unit group SC3. F1 is a main feed line from each fine spinning frame; the winding unit groups SC1 to SC3 have delivery lines f1 to f3 branched off from the main feed line F1. An empty bobbin or a bobbin with remaining yarn returns from the winding unit groups SC1 to SC3 to the fine spinning frames SP1 to SP3 through a common return line R and branched return lines r1 to r3 for returning the bobbins to the fine spinning frames.

In one place of the main feed line F1 is provided a yarn-end finding device ACF for leading out the yarn end from the spinning bobbin 1. And in the positions of inlets 11 and 12 of the delivery lines f1 and f2 of each winding unit group of the main feed line f1 are arranged the tray selectors 41. In the meantime, to the return line R is connected a passage R1 through the selector 45, to supply a bobbin with remaining yarn thereon to the yarn-end finding device ACF. In addition, a minimum-yarn removing device ST is provided for removing extremely small yarn remaining on the bobbin. A reference numeral 46 refers to a sensor for sensing a bobbin with remaining yarn, and 47 denotes a sensor for sensing a bobbin with minimum yarn remaining thereon. Furthermore, the tray selector 41 is disposed in each spinning frame position on the return line R. The spinning bobbin 1 coming from each fine spinning frame is wound on the color bobbin 2 of a color which varies with a difference in yarn thickness, and is mounted on the tray 3 the mark of which differs with the kind of yarn, being grouped and transferred by each yarn kind, or randomly transferred regardless of the yarn kind to the main feed line F1.

The spinning bobbin that has been transferred in the direction of the arrow 40, with its yarn end being found out by the yarn-end finding device ACF and hanging down in the center hole of the color bobbin 2 as shown in FIG. 2, is transferred on to the main feed line F1. A spinning bobbin with its yarn end not found out is fed again from a feedback passage 39 to the yarn-end finding device ACF. The spinning bobbin with its yarn end found out is transferred toward an automatic winder W on the main feed line F1. As shown in FIG. 5, the tray 3 with the specific mark is selected by the tray selector 41. A spinning bobbin 1, for example, from the fine spinning frame SP1 is fed onto the delivery line f1 by turning the gate 44 from the position indicated by a full line to the position 49 indicated by a broken line. In a similar manner, the spinning bobbin 1 from the fine spinning frame SP2 is fed to the delivery line f2 by the tray selector 41 of the corresponding winding unit group SC2. In this manner the spinning bobbin is fed to the winding unit group corresponding to each fine spinning frame; within each winding unit group, the specific spinning bobbin is taken into a standby groove on a disk 53 from an inlet groove 52 of each winding unit 51 shown in FIG. 6, from which the spinning bobbin is fed to the winding position in the condition that it is mounted on the tray 3, then being rewound.

However, on the conveyor line for conveying various kinds of bobbins described above, the tray 3 with a specific mark is selected: the spinning bobbin 1 itself is not selected. Therefore, wrong combination of the tray 3 and the spinning bobbin 1 is likely to occur. Generally, a difference in the yarn count is not visually distinguishable; in this case, all the lot on the automatic winder will become defective. To prevent this, any mistake in bobbin kind is not allowed absolutely.

This type of conveyor system for various kinds of bobbins, therefore, requires checking up to the combination of the tray 3 and the spinning bobbin 1. As shown in FIGS. 4 and 5, it has been proposed in prior art that color sensors 10A and 10B are installed in the main feed line F1 located at the front of each winding unit group to check whether the spinning bobbin wound on a specific color bobbin is inserted on the tray 3 carrying the specific mark. Also as shown in FIG. 7, either of the color sensors 10A and 10B is composed of a light projector 8 for projecting light, a light receiver 9 for receiving reflected light, and an electric circuit section (not illustrated) for color detection in accordance with a signal received from the light receiver. The color sensor 10A is mounted for sensing colors on the peripheral surface of the top end of the color bobbin 2, while the color sensor 10B, for sensing colors on the peripheral surface of the central projection of the tray 3. For example, a red color bobbin 2 should have been inserted on a white tray 3; a blue color ribbon 2, on a black tray 3; and a green color ribbon 2, on a blue tray 3. If the color combination of the tray 3 and the color bobbin 2 is wrong, the operation of the whole machine will be stopped to check for a cause of the wrong combination. The color sensors 10A and 10B are carried out during the transport of the tray 3 or during a pause.

In the conveyor system for carrying various kinds of bobbins described above, wrong combination of the tray and color bobbin can be checked after the discrimination of red, blue and green colors of the color bobbin by the color sensor 10A. However, since for example blue and green have common color components and the spinning bobbin inserted on the tray is being conveyed while rocking or stops aslant, it is not easy to discriminate red, blue and green by means of the color sensor 10A. Therefore, there have been proposed a method for dividing the hue components of each color by a luminance component which is a sum thereof, to remove waviness resulting from the rocking motion as disclosed in Japanese Patent Laid-Open No. Hei 1-185421, and a method for discriminating the hue components which are included in one color but not included in the other as disclosed in Japanese Patent Laid-Open No. Hei 1-192678. These methods, however, are not necessarily perfect; the prior-art conveyor system for various kinds of bobbins described above has such disadvantages that a specific color of the color bobbin is incorrectly discriminated, the whole machine is unnecessarily stopped, and its checks require much time.

SUMMARY OF THE INVENTION

In view of the above-described disadvantages inherent to heretofore known techniques, it is an object of the present invention to provide a conveyor system for carrying various kinds of bobbins which is capable of easily and reliably discriminating a wrong combination of a tray with a specific mark and a color bobbin of specific color.

It is another object of the present invention to provide a conveyor system for different kinds of bobbins which is capable of supplying only proper spinning bobbins without stopping the whole machine even when the proper spinning bobbins have been misjudged as wrong spinning bobbins.

To attain the object stated above, the conveyor system for carrying various kinds of bobbins according to the present invention is of such a design that a spinning bobbin wound on a color bobbin of a specific color is inserted on a tray with a specific mark; at least two kinds of trays being conveyed together on a main conveyor line are selected to be distributed to a delivery line of a specific winding unit group. In this conveyor system, a color sensor is provided on the delivery line for discriminating the color bobbin of a specific color.

The present invention has been accomplished to break such a common sense that the various kinds of bobbins have to be discriminated before they arrive at each winding unit group. First, a tray with a specific mark is distributed to the winding unit group and then is checked for wrong combination by means of a color bobbin sensor. That is, if the tray with the specific mark is distributed at first, the tray carrys a color bobbin of a specific color which can be discriminated by a color sensor: For example, it is sufficient to discriminate only whether or not the color is red, and there is no necessity to discriminate red, blue and green separately, thereby largely improving a discrimination accuracy.

The present invention also provides a conveyor system for conveying different kinds of bobbins, wherein from the main conveyor line on which two or more kinds of spinning bobbins are being carried together, only spinning bobbins of specific kind are transferred to the delivery line of the winding unit. This conveyor system is equipped with a detecting means for detecting spinning bobbins of wrong combination of a tray and color bobbin which is mounted on the main conveyor line or the delivery line, and a discharge means for discharging, to the outside of the system, the spinning bobbins of wrong combination thus detected by the detecting means before the bobbins arrive at, or after passing, the winding unit.

The discharge means is adopted to discharge spinning bobbins of wrong combination detected by the detecting means, out of the conveyor system, before the bobbins arrive at, or after they pass through, the winding unit, without being rewound at the winding unit and requiring to stop the whole machine.

Figure 3:
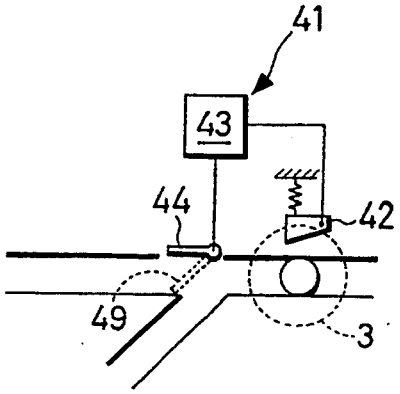
FIG. 3 PRIOR ART
Figure 5:
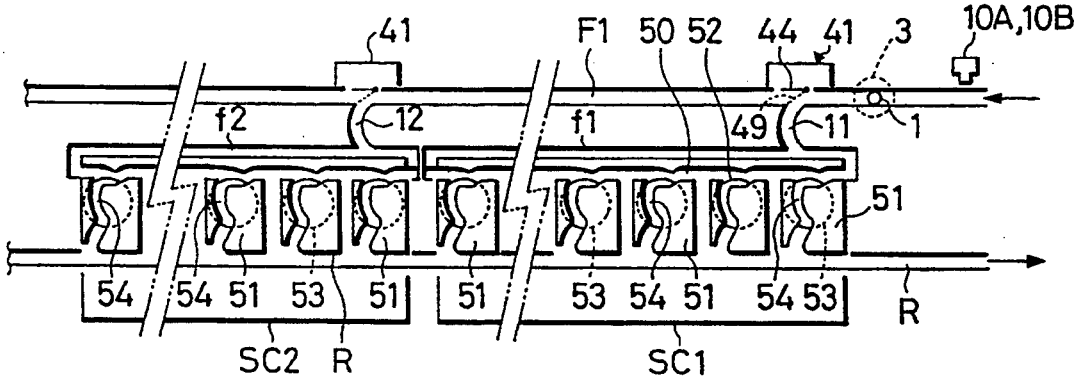
FIG. 5 PRIOR ART
Figure 4:
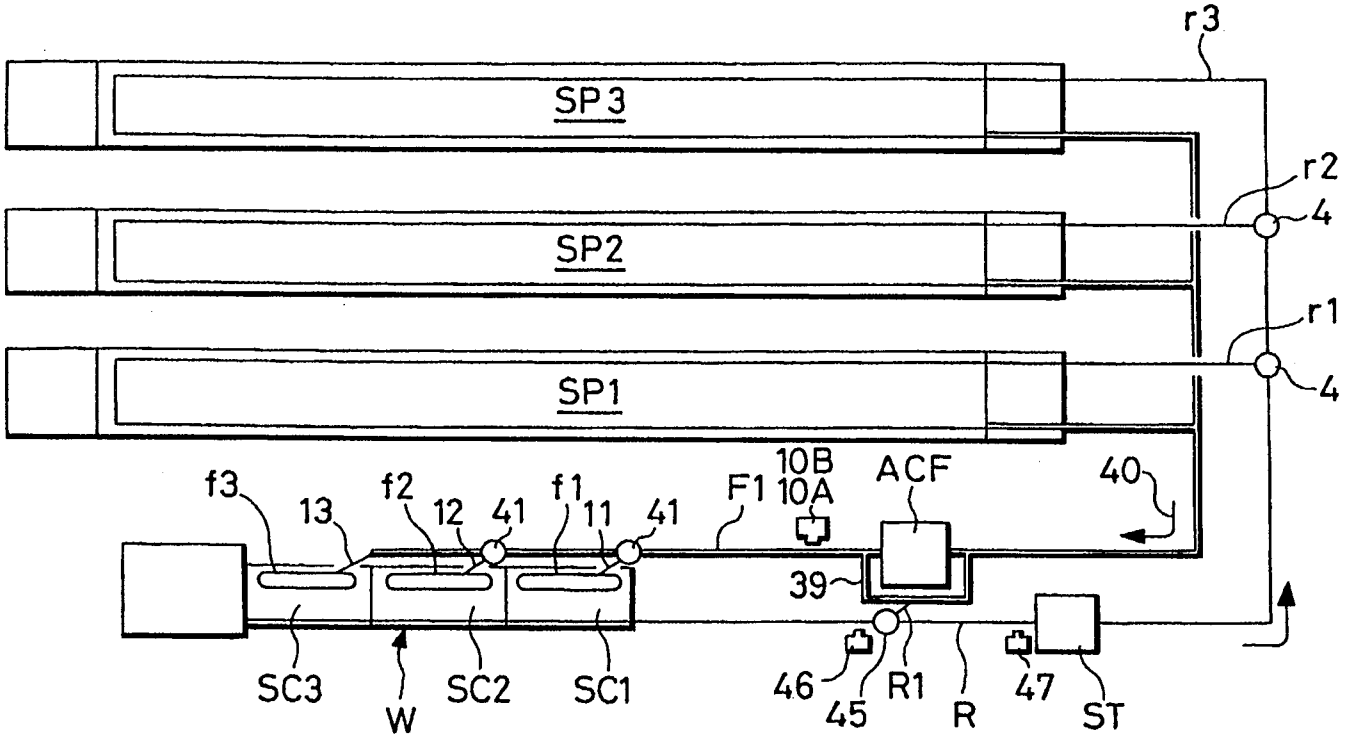
FIG. 4 PRIOR ART
Figure 6:
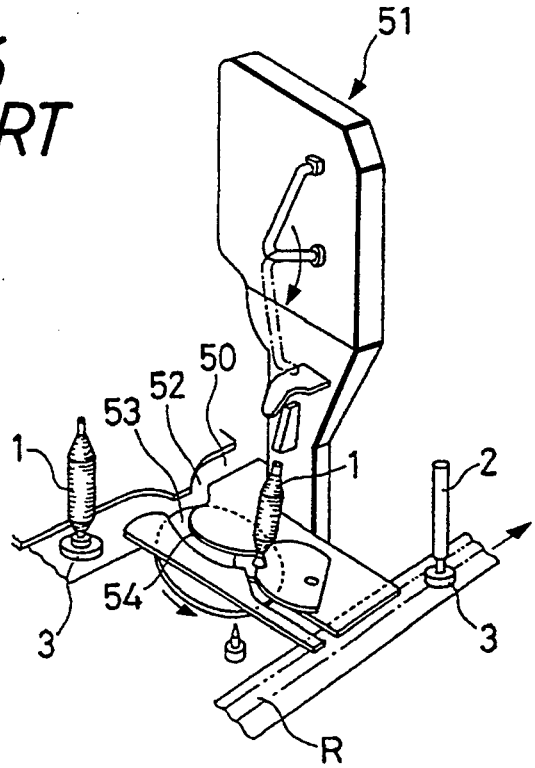
FIG. 6 PRIOR ART
Figure 7:
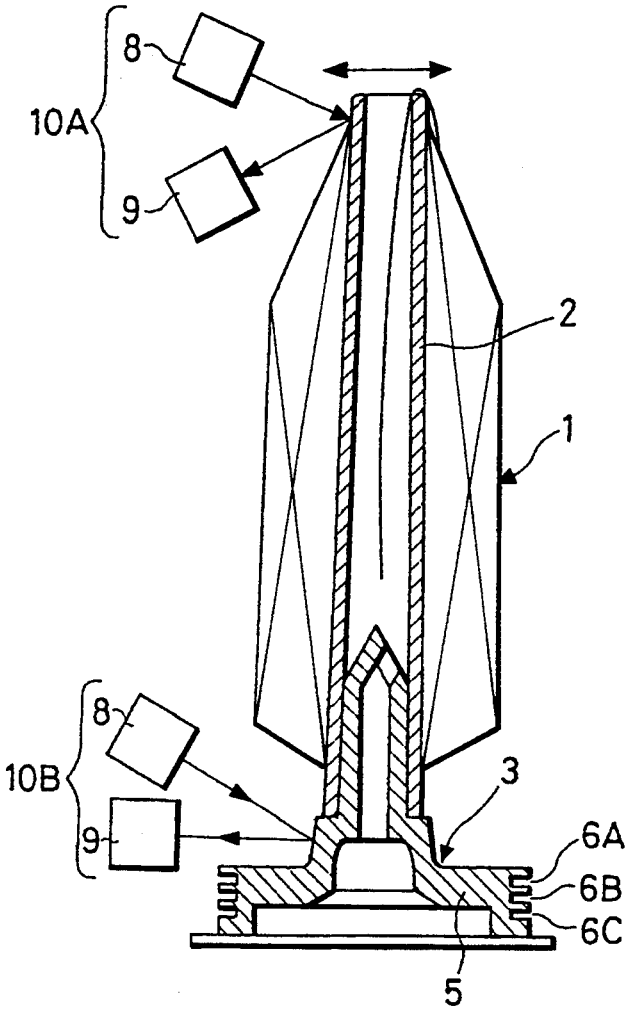
FIG. 7 PRIOR ART
Figure 8:
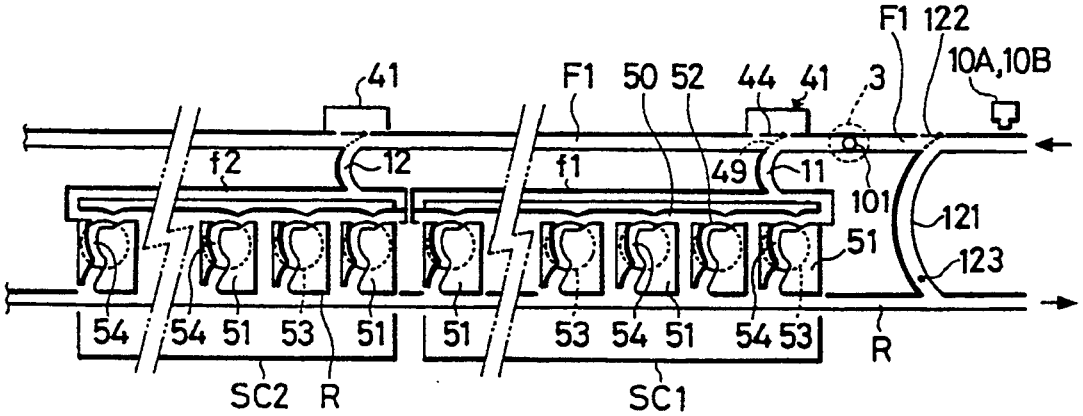
Figure 9:
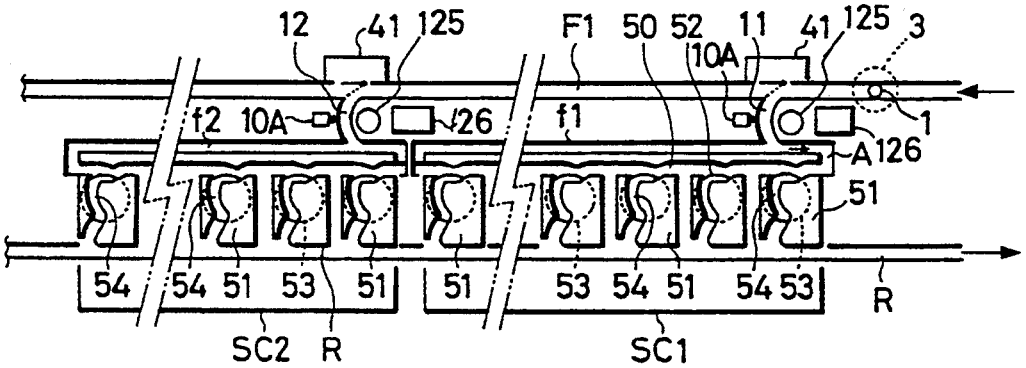
Figure 10:
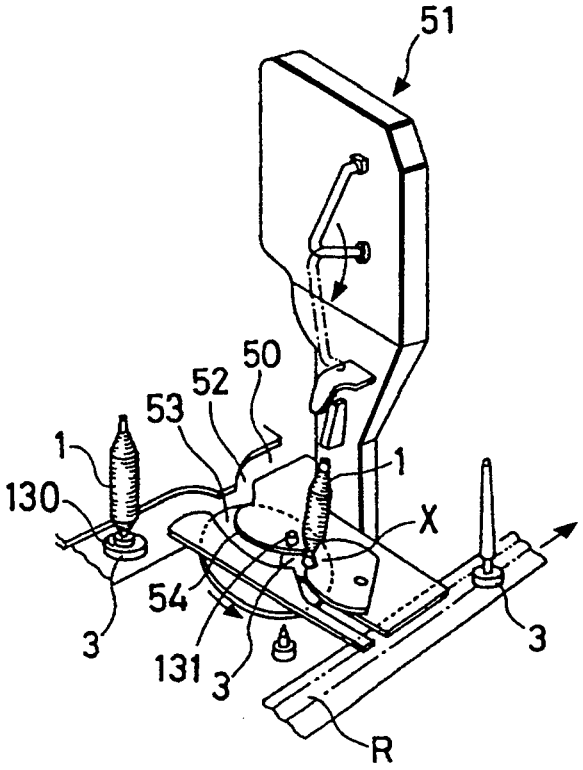

FIGS. *2a*, *2b* and *2c* are views showing the arrangement of a specific mark of a tray and a color sensor;

FIG. 3 is a view showing a tray selector;

FIG. 4 is a layout drawing showing one example of a prior-art conveyor system for carrying various kinds of spinning bobbins;

FIG. 5 is a plan view of a major portion of the prior-art conveyor system;

FIG. 6 is a perspective view of a winding unit;

FIG. 7 is a view showing the arrangement of a prior-art color sensor;

FIG. 8 is a plan view showing a major portion of a conveyor system of the second embodiment of the present invention;

FIG. 9 is a plan view showing a major portion of another conveyor system of the present invention; and FIG. 10 is a perspective view showing a major portion of further another conveyor system of the present invention.

DETAILED DESCRIPTION OF PREFERRED EMBODIMENTS

Figure 1:
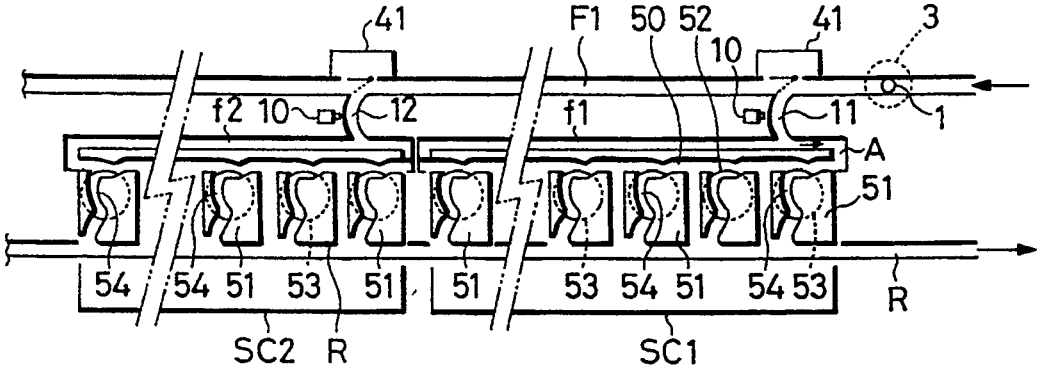
FIG. 1 is a plan view showing a major portion of a conveyor system according to the present invention.

Hereinafter an embodiment of a conveyor system for carrying various kinds of spinning bobbins according to the present invention will be explained with reference to the accompanying drawings. FIG. 1 is a plan view showing a major portion of the conveyor system. A difference from a prior art of FIG. 5 lies in that the color sensor 10 for checking the color of the color bobbin is mounted on the delivery line of each winding unit. Other points, being the same as FIG. 5, are designated with the same reference numerals and not described.

In FIG. 1, the tray selectors 41 are mounted in positions corresponding to the winding unit groups SC1 and SC2 of the main feed line F1, and select trays provided with a special mark, then distributing them to the delivery lines f1 and f2 as in conventional ones. However, the color sensors 10 are located at the inlets 11 and 12 of the delivery lines f1 and f2, to detect the color of the color bobbin inserted on the tray with the specific mark. This color sensor 10 can be located so as to aim at for example the point A on the main stream side off the inlets 11 and 12. That is, the color bobbin sensors 10 are located in the passage through which spinning bobbins are taken in from the tray selector 41 to each winding unit 51.

Figure 2A:
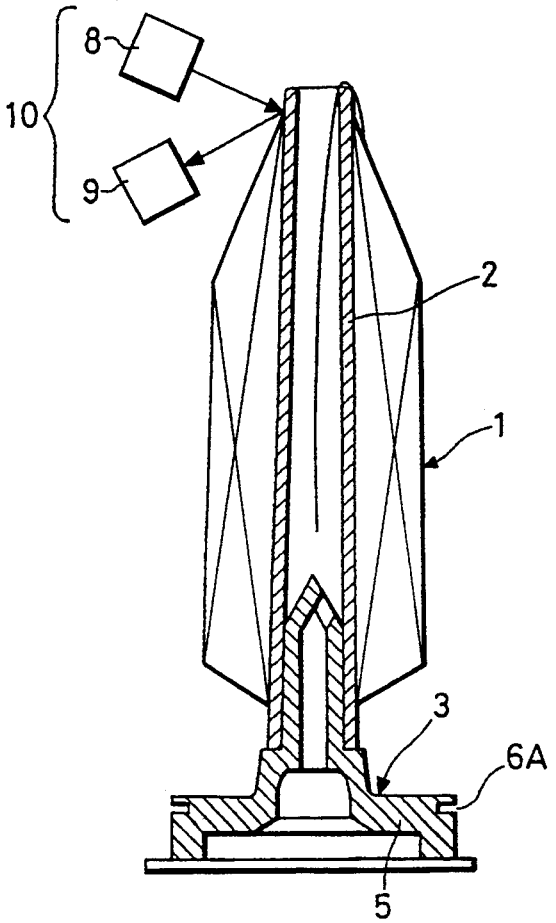
Figure 2B:
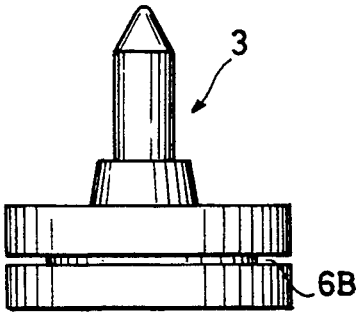
Figure 2C:
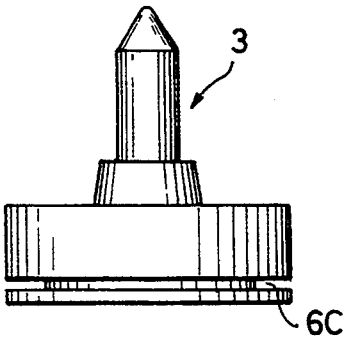

As shown in FIG. 2, this color sensor 10 comprises a light projector 8 for projecting light, a light receiver 9 for receiving reflected light, and an electric circuit section (not illustrated) for detecting colors in accordance with a signal from the light receiver. The color sensor 10 is so installed as to aim at the periphery of the top end part of the color bobbin 2. After the distribution of the tray having the specific mark, the color bobbin should have the specific color, and accordingly this color sensor 10 is required only to discriminate whether the color is red for example. If the color is other than red, a wrong combination can be discriminated; that is, it is unnecessary to discriminate blue or green, thereby largely improving the discrimination accuracy of the color bobbin sensor 10, reducing the change for discriminating a normal combination as wrong one, and accordingly lowering the machine operation efficiency. When the color sensor 10 has judged that the color bobbin is not one of a specific color, it signifies the occurrence of a serious trouble: a wrong combination of a tray with specific mark and a color bobbin of specific color. Thus, checks will be made by stopping winding at least at the winding unit groups SC1 and SC2.

The conveyor system for carrying various kinds of bobbins according to the present invention is equipped with color sensors on the delivery line for discriminating color bobbins of specific colors. A tray with a specific mark, when distributed, can receive a color bobbin of specific color. The color sensor, therefore, is sufficient if it discriminates only whether or not the color sensed is a specific color, for example, whether the color is red. It is unnecessary to discriminate whether the color sensed is red, blue, green or yellow; therefore a wrong combination of tray and color bobbin can easily and reliably be discriminated.

The second embodiment of the conveyor system according to the present invention will be explained by referring to FIGS. 8 to 10.

The present invention also provides another embodiment of conveyor system for conveying different kinds of bobbins, wherein from the main conveyor line on which two or more kinds of spinning bobbins are being carried together, only spinning bobbins of specific kind are transferred to the delivery line of the winding unit. This conveyor system is equipped with a detecting means for detecting spinning bobbins of wrong combination of a tray and color bobbin which is mounted on the main conveyor line or the delivery line, and a discharge means for discharging, to the outside of the system, the spinning bobbins of wrong combination thus detected by the detecting means before the bobbins arrive at, or after passing, the winding unit. FIG. 8 is a plan view showing a major portion of the conveyor system of this embodiment.

In FIG. 8 a bypass line 121 equipped with a stopper 123 is provided between the main conveyor line F1 and the return line R before the inlet 11 of the winding unit group SC1 and after the color sensors 10A and 10B. Further a selector 122 is provided at the inlet of the bypass line 121. This selector 122 operates to switch from a full-line position to a dotted-line position when a spinning bobbin of wrong combination has been judged by color sensors 10A and 10B, and guides the spinning bobbin of wrong combination to the bypass line 121, storing them at the front of the stopper 123. When the spinning bobbins of wrong combination have been stored to some extent, a warning will be given to an operator, so that the operator can check the spinning bobbins of wrong combination of a tray and color bobbin. In case of malfunction of the color sensor arising due to the presence of a smear on the color bobbin, the operator will clean off the smear of the color bobbin and manually return it to the return line R. In this case, the spinning bobbin of wrong combination will be returned for recirculation, by a detector 46 for detecting a bobbin with remaining yarn of FIG. 4, to a main conveyor line F1 through a feedback passage 39 and a yarn-end finding device ACF. Then, when the spinning bobbin is really one which is incorrectly carried on a tray, it is possible that there has occurred some trouble with the equipment within the circulation system. In this case, the whole machine will be stopped and checked. The bobbins may be stocked on an individual tray stocker, without returning to the return line R through the bypass line 121 of FIG. 8, and will be checked by the operator. In this manner, when the system capable of checking by the operator is adopted, with the spinning bobbins of wrong combination discharged out of the system of the main conveyor line F1, it will become unnecessary to stop the whole machine even when a proper color bobbin has been detected as a bobbin of wrong combination due to the presence of smear, and the operator can visually check of the spinning bobbin is really a spinning bobbin of wrong combination, and thereafter the whole machine can be stopped. A reference numeral 41 refers to a tray selector, and a numeral 44 denotes a gate. A tray 3 of specific mark is selected by the tray selector 41, and the gate 44 is switched to the broken-line position 49, distributing the spinning bobbin 1 of specific kind to the inlet 11. A reference numeral 50 is a part of the delivery line; 51 is a winding unit; 52 is a inlet port for taking the spinning bobbin into the winding unit 51; 53 is a disk for carrying the bobbin to the winding position; and 54 is a standby groove.

FIG. 9 is a plan view showing a major portion of further another conveyor system of the present invention. A difference from FIG. 8 lies in that the color sensors 10A for detecting the color of the color bobbin are mounted at the inlets 11 and 12 of the winding groups SC1 and SC2, and a bobbin removing device 125 and a bobbin box 126 are provided correspondingly to the color sensors 10A. When the spinning bobbin of wrong combination is sensed by the color sensor 10A, the bobbin removing device 125 pulls off the spinning bobbin 1 from the tray 3, and puts the spinning bobbin 1 into the bobbin box 126; and this operation is displayed on a central control panel. The color sensor 10A of FIG. 8 can check a spinning bobbin of wrong combination only after the discrimination of for example red, blue and green of the color bobbin 2. However, for example blue and green have common hue components, and a spinning bobbin inserted upright on the tray is being conveyed while rocking, or stops aslant, and therefore it is not easy to discriminate red, blue and green by the color sensor 10A. However, since the color sensor 10A of FIG. 9 is located after the distribution of trays having a specific mark, the color bobbin of specific color should have been selected; it is sufficient for this color sensor 10A to discriminate whether or not the color is red for example. If the color is other than red, a spinning bobbin of wrong combination has been discriminated, and it is not required to discriminate blue or green. Therefore, the detection accuracy of the color bobbin sensor 10A of FIG. 9 can be improved remarkably as compared with that shown in FIG. 8, thereby reducing the change of incorrect detection of a proper spinning bobbin as a spinning bobbin of wrong combination.

FIG. 10 is a perspective view showing a major portion of further another conveyor system of the present invention, that is one spindle of the winding unit. The surface of the tray 3 is lined with a hollow disc-like magnetic member 130, so that bobbin information may be written in a form of concentric circle. When the color sensor has detected wrong combination, an information on the detection of the wrong combination will be written in the magnetic member 130. Furthermore, there is provided a sensor 131 for reading the magnetic member 130 of the tray 3 in the winding position X of the winding unit 51. Since the information has been written in the concentric circular, form, only reading a part of the tray 3 in a radial direction suffices. Where the information on the spinning bobbin of wrong combination has been entered, the winding unit 51 will not rewind the spinning bobbin 1, but will allow it to pass through to return to the return line R. On the return line R also, a sensor is provided for reading information on the spinning bobbin of wrong combination of the tray 3, which will be discharged out of the system by means of the selector. A reference numeral 50 is a part of the delivery line; 52 refers to an inlet port for taking the spinning bobbin into the winding unit 51; 53 is a disc for carrying the spinning bobbin to the winding position; and 54 denotes a standby groove.

According to the conveyor system for carrying different kinds of bobbins of the present invention, a discharge means is adopted to discharge spinning bobbins of wrong combination detected by the detecting means, out of the system before they reach the winding unit, or after they pass through, without winding back the spinning bobbins of wrong combination by the winding unit and without a necessity to stop the whole machine. Therefore even when proper spinning bobbins are judged to be those of wrong combination, only proper spinning bobbins can be supplied, thereby improving the operation efficiency of the machine. Particularly when the color sensors are adopted as means for detecting the spinning bobbins of wrong combination, even a proper spinning bobbin is often detected as a spinning bobbin of wrong combination due to the presence of smear on the bobbin. The use of the color sensors, therefore, is effective for the conveyor system in which the detection of spinning bobbins of wrong combination is required.

What is claimed is:

1. A system for conveying a plurality of bobbins having different types of yarn thereon, comprising:

a plurality of trays, each of the plurality of trays having a yarn type identifier corresponding to one of the different types of yarn, a plurality of cores configured to be placed on the trays and around which yarn is windable, each of the plurality of cores having a yarn type identifier corresponding to one of the different types of yarn, a plurality of winding unit groups, a main line for conveying the plurality of trays toward the winding unit groups, a plurality of delivery lines for conveying the plurality of trays from the main line to the plurality of winding unit groups, at least one tray selector provided substantially adjacent the main line for directing a tray from the main line to at least one of the plurality of delivery lines based upon the yarn type identifier of the tray, and at least one sensor provided substantially adjacent the delivery line for sensing the yarn type identifier of the core placed on the tray directed to the delivery line.

2. The system of claim 1, comprising:

a core remover provided adjacent the delivery line for removing a core from a tray in response to a signal from the sensor indicating that the yarn type identified by the yarn type identifier of the core does not correspond to the yarn type identified by the yarn type identifier of the tray.

3. The system of claim 1, wherein the winding unit groups comprise at least one winding unit defining a winding position, and further comprising:

a return line, a substantially disc-like magnetic member provided on a surface of the tray onto which information is writable, including information indicating that the yarn type identified by the yarn type identifier of the core does not correspond to the yarn type identified by the yarn type identifier of the tray, a sensor for reading information written onto the magnetic member when the tray is in the winding position of the winding unit, whereby a bobbin passes through the winding unit to the return line without rewinding when the sensor reads information written onto the magnetic member indicating that the yarn type identified by the yarn type identifier of the core does not correspond to the yarn type identified by the yarn type identifier of the tray.

4. The system of claim 1, wherein the yarn type identifier of the tray comprises a slit in the tray and wherein the yarn type identifier of the core comprises a color of the core.

5. A system for conveying a plurality of bobbins having different types of yarn thereon, comprising:

a plurality of trays, each of the plurality of trays having a yarn type identifier corresponding to one of the different types of yarn, a plurality of cores configured to be placed on the trays and around which yarn is windable, each of the plurality of cores having a yarn type identifier corresponding to one of the different types of yarn, a plurality of winding unit groups comprising at least one winding unit, a main line for conveying the plurality of trays toward the winding unit groups, a plurality of delivery lines for conveying the plurality of trays from the main line to the plurality of winding unit groups, detecting means provided substantially adjacent at least one of the main line and the delivery lines for detecting whether the yarn type identified by the yarn type identifier of the core corresponds to the yarn type identified by the yarn type identifier of the tray, and discharge means for discharging a bobbin from the system prior to arrival of the bobbin at a winding unit in response to a detection by the detecting means that the yarn type identified by the yarn type identifier of the core does not correspond to the yarn type identified by the yarn type identifier of the tray, whereby bobbins are discharged from the system without rewinding and without stopping the system when the detecting means detects that the yarn type identified by the yarn type identifier of the core does not correspond to the yarn type identified by the yarn type identifier of the tray.

* * * * *